United States Patent [19]

Helm

[11] Patent Number: 5,012,412

[45] Date of Patent: Apr. 30, 1991

[54] METHOD AND APPARATUS FOR MEASUREMENT OF AZIMUTH OF A BOREHOLE WHILE DRILLING

[75] Inventor: Walter A. Helm, Plainville, Conn.

[73] Assignee: Teleco Oilfield Services Inc., Meriden, Conn.

[21] Appl. No.: 275,115

[22] Filed: Nov. 22, 1988

[51] Int. Cl.[5] ..... E21B 47/022

[52] U.S. Cl. ..... 364/422; 33/302; 33/313

[58] Field of Search ..... 33/302–304, 33/312, 313; 364/422; 75/151

[56] References Cited

U.S. PATENT DOCUMENTS

| | | | |
|---|---|---|---|
| 4,163,324 | 8/1979 | Russell et al. | 33/313 |
| 4,433,491 | 2/1982 | Ott et al. | 33/302 |
| 4,472,884 | 9/1984 | Engebretson | 33/312 |
| 4,709,486 | 12/1987 | Walters | 33/304 |

*Primary Examiner*—Jerry Smith
*Assistant Examiner*—Kim Thanh Tbui
*Attorney, Agent, or Firm*—Fishman, Dionne & Cantor

[57] ABSTRACT

A method and apparatus is presented for measuring the azimuth angle of a borehole being drilled, the data for determining the azimuth angle being obtained while the drillstring is rotating.

29 Claims, 13 Drawing Sheets

METHOD AND APPARATUS FOR MEASUREMENT OF AZIMUTH OF A BOREHOLE WHILE DRILLING

BACKGROUND OF THE INVENTION

This invention relates to the field of borehole measurement. More particularly, this invention relates to the field of measurement while drilling (MWD) and to a method of measuring the parameter of azimuth while the drill string is rotating.

In MWD systems, the conventional approach is to take certain borehole parameter readings or surveys only when the drillstring is not rotating. U.S. Pat. No. 4,013,945, owned by the assignee hereof, discloses and claims apparatus for detecting the absence of rotation and initiating the operation of parameter sensors for determining azimuth and inclination when the absence of rotation is sensed. While there have been several reasons for taking various MWD measurements only int he absence of drill string rotation, a principal reason for doing so is that previous methods for the measurement or determination of angles of azimuth and inclination required the tool to be stationary in order for the null points of single axis devices to be achieved; or to obtain the averaging necessary when triaxial magnetometers and triaxial accelerometers are used for determining azimuth and inclination. That is, when triaxial magnetometers and accelerometers are used, the individual field measurements necessary for determination of azimuth and inclination are dependent on instantaneous tool face angle when the measurements are taken. This is so because during rotation the x and y axis magnetometer and accelerometer readings are continually varying, and only the z axis reading is constant. In referring to x, y and z axis, the frame of reference is the borehole (and the measuring tool), with the z axis being along the axis of the borehole (and tool), and with the x and y axes being mutually perpendicular to the z axis and each other. That frame of reference is to be distinguished from the earth frame of reference to east (E), north (N) (or horizontal) and vertical (D) (or down).

There are, however, circumstances where it is particularly desirable to be able to measure azimuth and inclination while the drillstring is rotating. Examples of such circumstances include (a) wells were drilling is particularly difficult and any interruption in rotation will increase drill string sticking problems, and (b) situations where knowledge of instantaneous bit walk information is desired in order to know and predict the real time path of the borehole. A system has heretofore been proposed and used for obtaining inclination while the drillstring is rotating. In addition, U.S. patent application Ser. Nos. 054,616 and 054,552, both filed on May 27, 1987, disclose methods for obtaining azimuth measurements while rotating. Both applications are assigned to the assignee hereof, and fully incorporated herein by reference.

Unfortunately, measurement of rotating azimuth and inclination disclosed in U.S. application Ser. Nos. 054,616 and 054,552 suffer from a number of problems. The inclination (as disclosed in application Ser. No. 054,616) suffers from sensitivity problems at low inclination as well as acquisition problems due to occasional accelerometer channel saturation while drilling. Inclination while rotating is determined by gz/g using the z axis accelerometer (gz) alone and computing the arc cosine of the averaged data. The cosine response is responsible for sensitivity problems at low inclinations. The straight averaging is responsible for the error contribution of saturation. This is because except at 90° inclination, the accelerometer output is closer to saturation in one direction than the other. On average then, the accelerometer will saturate more in one direction than the other. This would have the effect of skewing the average towards zero. Equivalently, the resulting inclination error will be in the direction of 90°. This is consistent with field test data.

Similarly, the rotating azimuth measurement also is error prone. The rotating azimuth calculation requires the measurement of the magnetometer z axis (hz) output while rotating. This data is combined with total magnetic field (ht) and Dip angle measurements made while not rotating, and with inclination data. The Hz measurement is analogous to the Gz measurement for inclination except that the Hz measurement can be made quite accurately. The analogy is drawn because in the absence of tool face information, the locus of possible tool orientations knowing only inclination (from gz) is a cone around vertical. The locus of tool orientations knowing Hz, Dip angle and ht is also a cone. This cone is centered on the magnetic field axis. The rotating azimuth calculation is simply the determination of the direction of the horizontal projection of the intersection of these two cones except at 0° and 180° azimuth. This produces the east-west ambiguity in the calculation. Since the angle of intersection becomes vanishingly small as the actual azimuth approaches 0° or 180°, small errors in either cone angle measurement will result in large errors in calculated azimuth. Under some circumstances, the magnitude of this azimuth related azimuth error may be unacceptable.

SUMMARY OF THE INVENTION

The above-discussed and other problems and deficiencies of the prior art are overcome or alleviated by the method of measuring the azimuth angle of a borehole while the drill string is being rotated. In accordance with the method of the present invention, Discrete Fourier Transformations (DFT) are used to determine improved rotating azimuth and inclination measurements.

The rotating inclination measurement can be improved by determining the magnitude of the gx(t) or gy(t) signal component at the rotation frequency. Inclination can be calculation using the Gx and/or Gy magnitudes (designated as $|Gx|$ and $|Gy|$) with a time averaged gz (designated as Gz)

It will be appreciated that finding the Gz or Gy spectral line corresponding to the rotation rate may be impossible without additional information. Fortunately, this information exists in the form of the hx(t) or hy(t) signal. Because these signals are not vibration sensitive, the only major spectral line in these signals will be at the rotation rate. In fact, for inclination alone, zero crossings of Hx or Hy provide sufficient information to determine rotation rate.

In accordance with the present invention, the DFT of hx(t) or hy(t) combined with the DFT of gx(t) or gy(t) and the time average of hz(t) and gz(t) provides sufficient information to determine an unambiguous azimuth. Specifically, a rotating azimuth can be accurately calculated for any orientation if inclination (Inc) (the angle between the tool axis and vertical), and magnetic inclination of theta ($\theta$) (the angle between the tool axis and the earth's magnetic field vector), and PHI ($\phi$) (the phase angle between the fundamental frequency component of hx(t) (or hy(t)) and that of gx(t) (or gy(t)) is known.

The above-discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

The method of the present invention is intended to be implemented in conjunction with the normal commercial operation of a known MWD system and apparatus of Teleco Oilfield Services Inc. (the assignee hereof) which has been in commercial operation for several years. The known system is offered by Teleco as its CDS (Computerized Directional System) for MWD measurement; and the system includes, inter alia, a triaxial magnetometer, a triaxial accelerometer, control, sensing and processing electronics, and mud pulse telemetry apparatus, all of which are located downhole in a rotatable drill collar segment of the drill string. The known apparatus is capable of sensing the components gx, gy and gz of the total gravity field gt; the components hx, hy and hz of the total magnetic field ht; and determining the tool face angle and dip angle (the angle between the horizontal and the direction of the magnetic field). The downhole processing apparatus of the known system determines azimuth angle (A) and inclination angle (I) in a known manner from the various parameters. See e.g., the article "Hand-Held Calculator Assists in Directional Drilling Control" by J. L. Marsh, Petroleum Engineer International, July & September, 1982.

Figure 1:
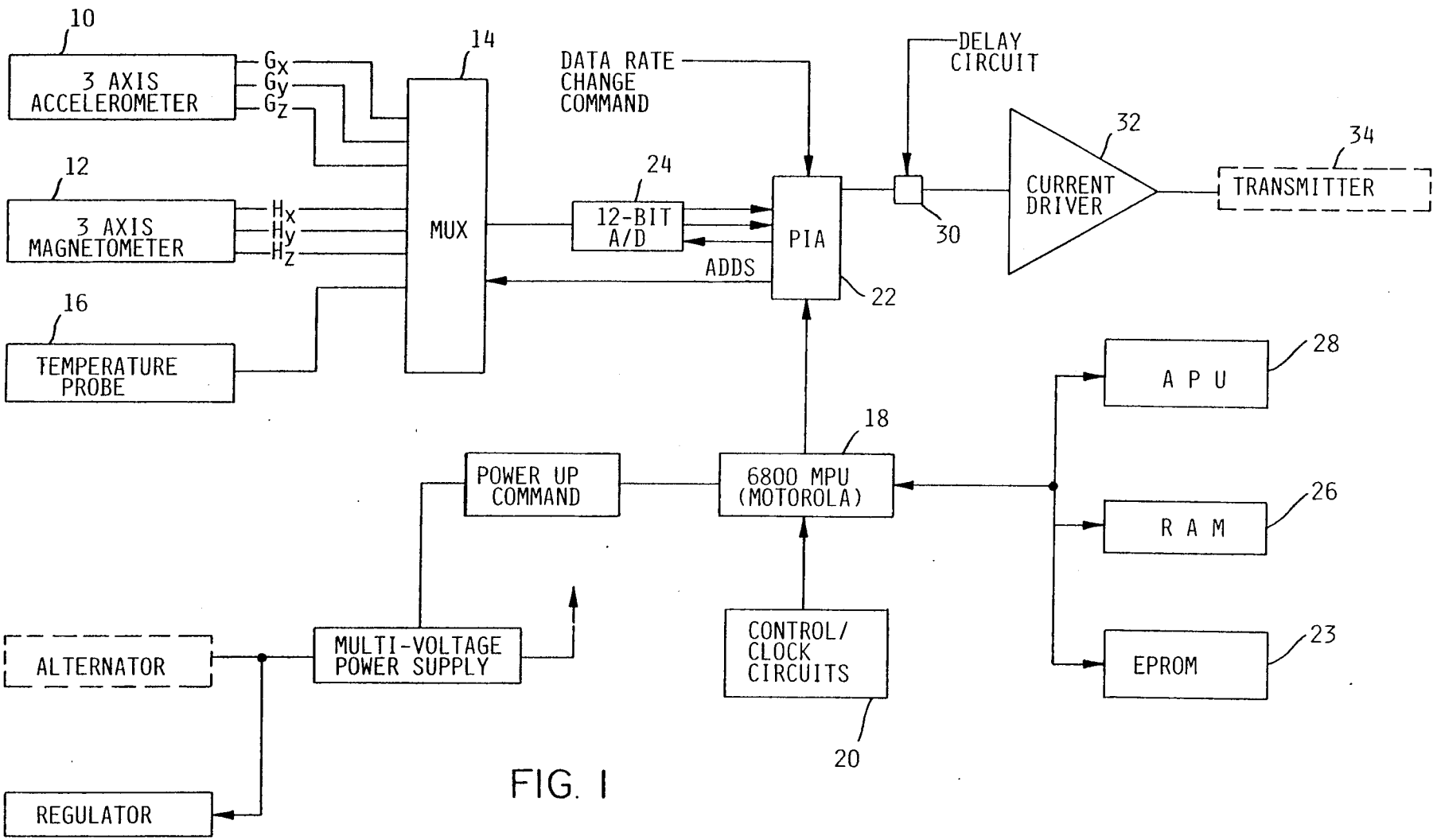
FIG. 1 is a block diagram of a known Computerized Direction System (CDS) used in borehole telemetry.

Referring to FIG. 1, a block diagram of the known CDS system of Teleco is shown. This CDS system is located downhole in the drill string in a drill collar near the drill bit. This CDS system includes a 3-axis accelerometer 10 and a 3-axis magnetometer 12. The z axis of each of the accelerometer and the magnetometer is on the axis of the drillstring. To briefly and generally describe the operation of this system, accelerometer 10 senses the gx, gy and gz components of the downhole gravity field gt and delivers analog signals commensurate therewith to a multiplexer 14. Similarly, magnetometer 12 senses the hx, hy and hz components of the downhole magnetic field ht. A temperature sensor 16 senses the downhole temperature of the accelerometer and the magnetometer and delivers a temperature compensating signal to multiplexer 14. The system also has a programmed microprocessor unit 18, system clocks 20 and a peripheral interface adapter 22. All control, calculation programs and sensor calibration data are stored in EPROM Memory 23.

Under the control of microprocessor 18, the analog signals to multiplexer 14 are multiplexed to the analog-to-digital converter 24. The output digital data words from A/D converter 24 are then routed via peripheral interface adapter 22 to microprocessor 18 where they are stored in a random access memory (RAM) 26 for the calculation operations. An arithmetic processing unit (APU) 28 provides off line high performance arithmetic and a variety of trigonometry operations to enhance the power and speed of data processing. The digital data for each of gx, gy, gz, hx, hy, hz are averaged in arithmetic processor unit 24 and the data are used to calculate azimuth and inclination angles in microprocessor 18. These angle data are then delivered via delay circuitry 30 to operate a current driver 32 which, in turn, operates a mud pulse transmitter 34, such as is described, for example, in U.S. Pat. No. 4,013,945.

In the prior art normal operation of the CDS system, the accelerometer and magnetometer readings are taken during periods of nonrotation of the drill string. As many as 2000 samples of each of gx, gy, gz, hx, hy and hz are taken for a single reading, and these samples are averages in APU 26 to provide average readings for each component. A procedure has also previously been implemented to determine inclination (I) while the drill string was rotating. In that procedure, the $(Gz)\frac{1}{2}$ component of the gravity field is determined from an average of samples obtained while rotating, and the inclination angle (I) is determined from the simple relationship $$\tan(I) = \frac{Gt^2 - Gz^2}{Gz} \tag{1}$$

where Gt is taken to be 1G (i.e., the nominal value of gravity). This system is acceptable for measuring inclination while rotating, because the z axis component Gz is not altered by rotation.

Figure 2:
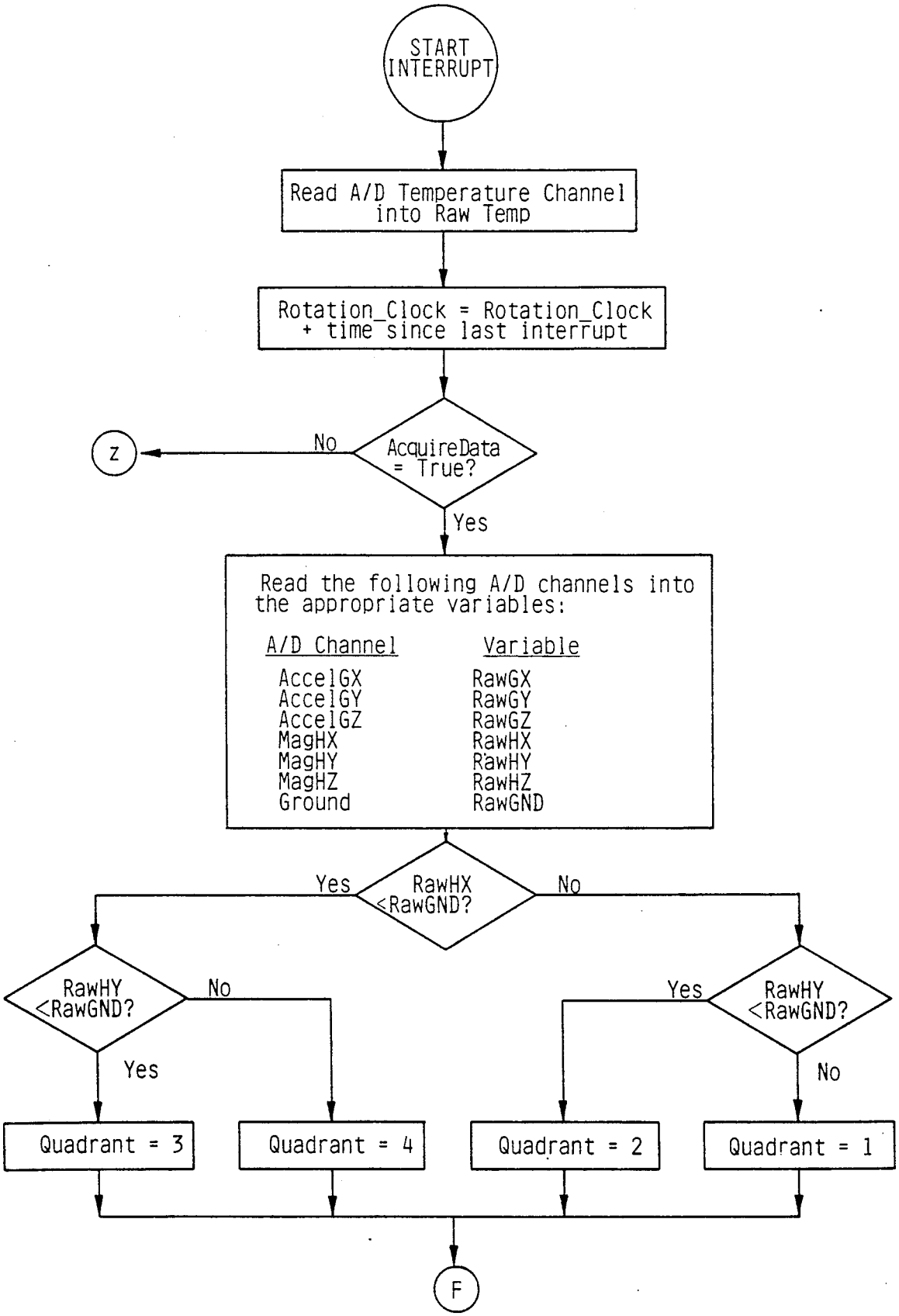
FIGS. 2–13 are flow charts depicting the software used in conjunction with the method of the present invention.
Figure 3:
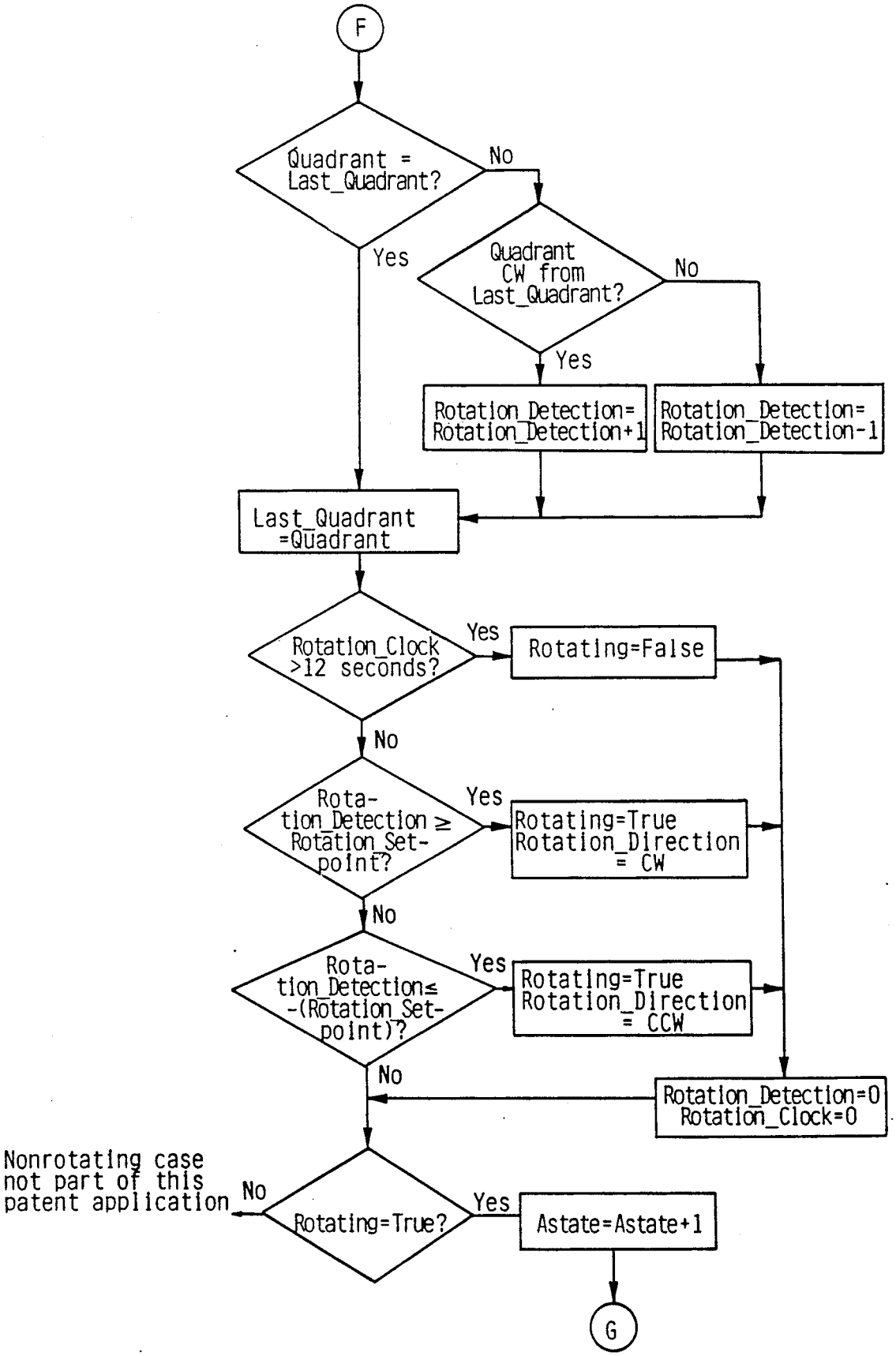

In accordance with the present invention and as depicted in the flow charts of FIGS. 2–13 and Tables 2–4, the measurement of the various parameters needed to determine the tool's inclination and azimuth while rotating are as follows:

Turning first to the interrupt routine of FIGS. 2–8, throughout the measurement of the inclination and azimuth, rotation of the drill string is continuously detected by monitoring the magnetometer output hx and hy. This rotation measurement is shown in FIGS. 2 and 3 and determines the rotation direction (e.g. clockwise or counterclockwise) in addition to detecting the rate of rotation. It will be appreciated that rotation rate information of this type may be obtained by the rotation sensor for borehole telemetry disclosed in U.S. Pat. No. 4,013,945, while is assigned to the assignee hereof and fully incorporated herein by reference. It will also be appreciated that the presence of two perpendicular magnetometer sensors (hx and hy) in the CDS permits determination of direction of rotation as well.

Figure 4:
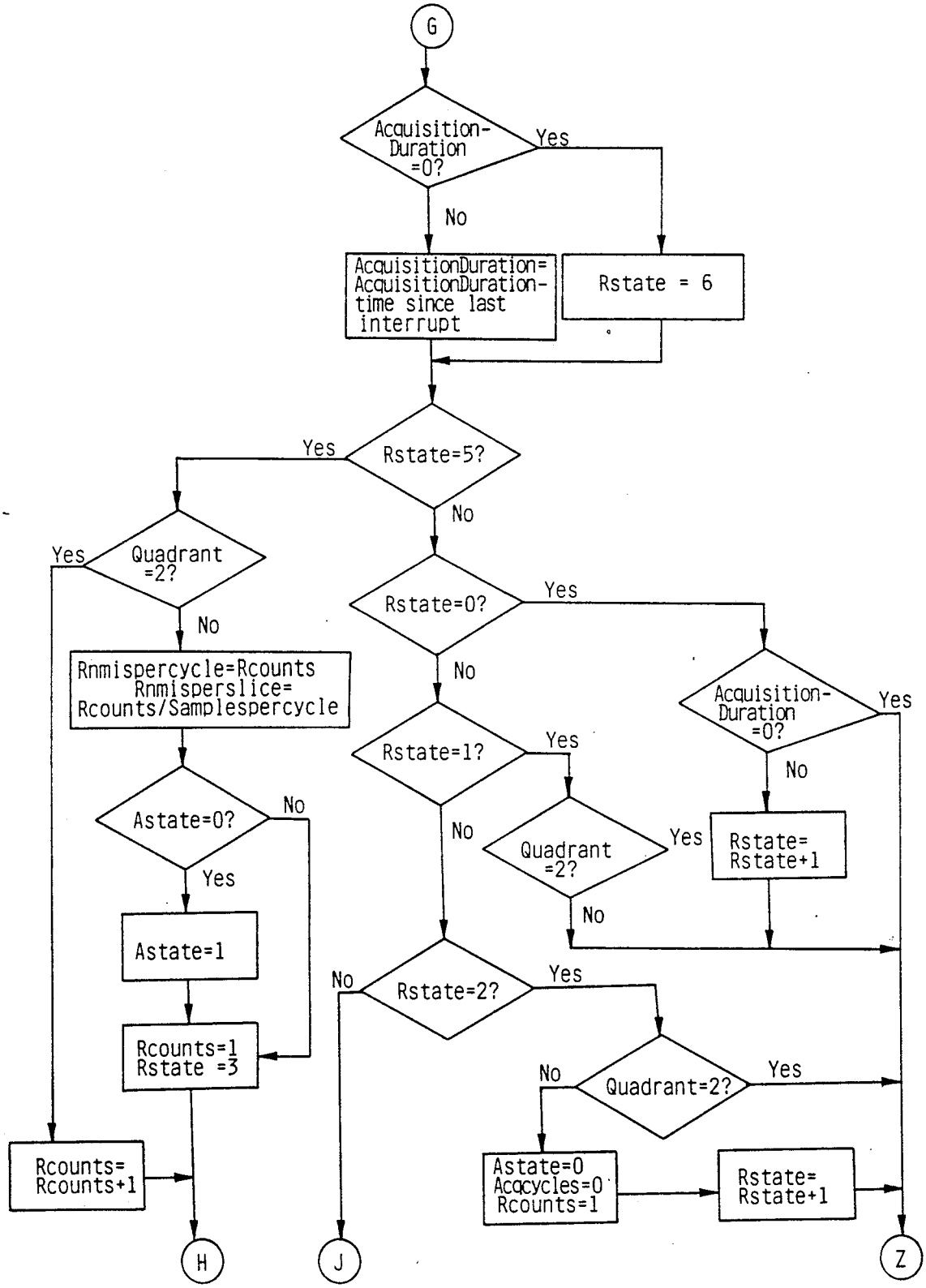
Figure 5:
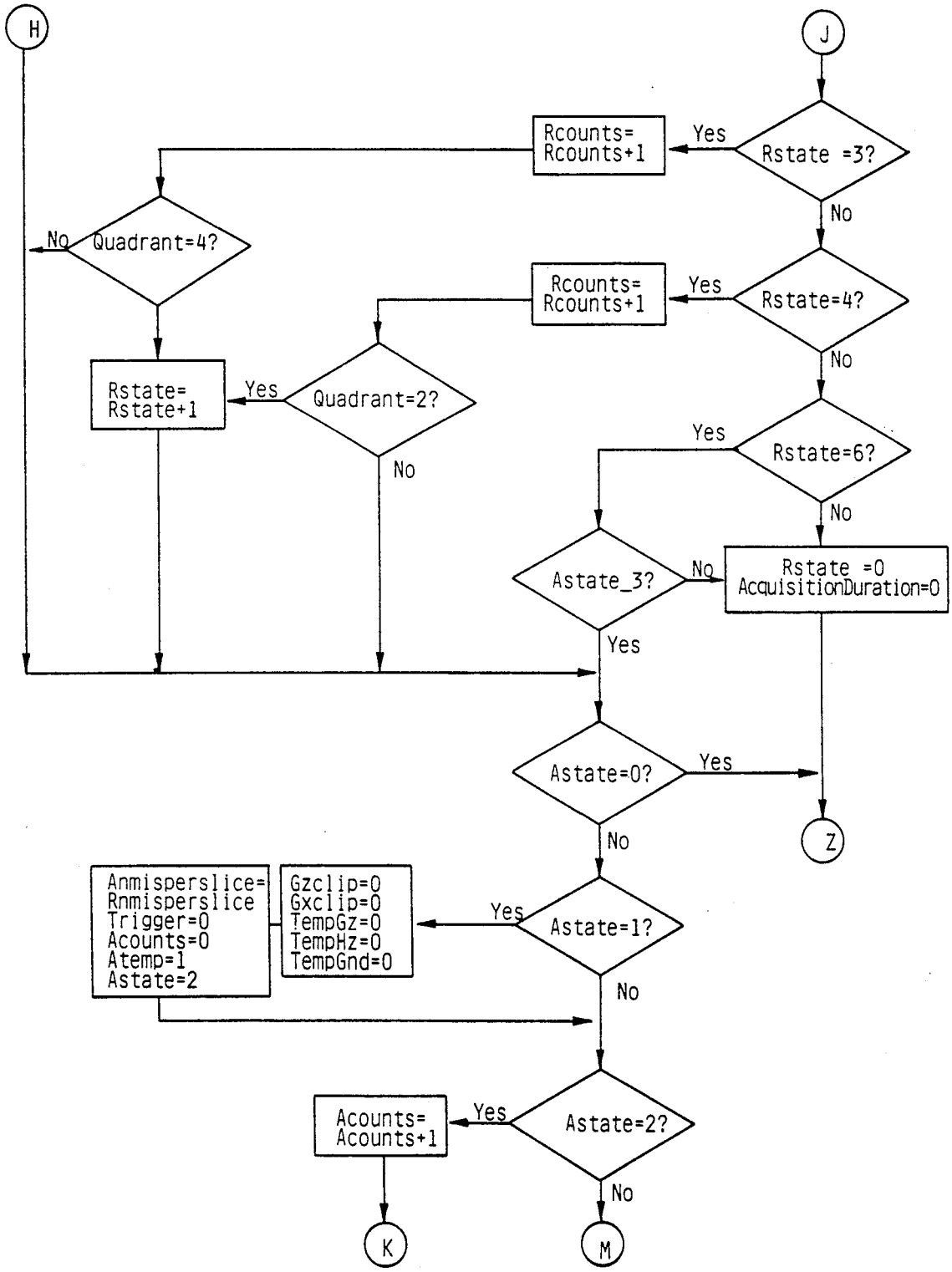

As shown in FIGS. 4 and 5, a data sampling rate is then established such that the number of instaneous samples taken of hx, gx, hz, and gz over one tool revolution (cycle) is, on average, a constant (for example 128) from cycle to cycle. The sample rate is adjusted at the end of each cycle to maintain the constant.

Figure 6:
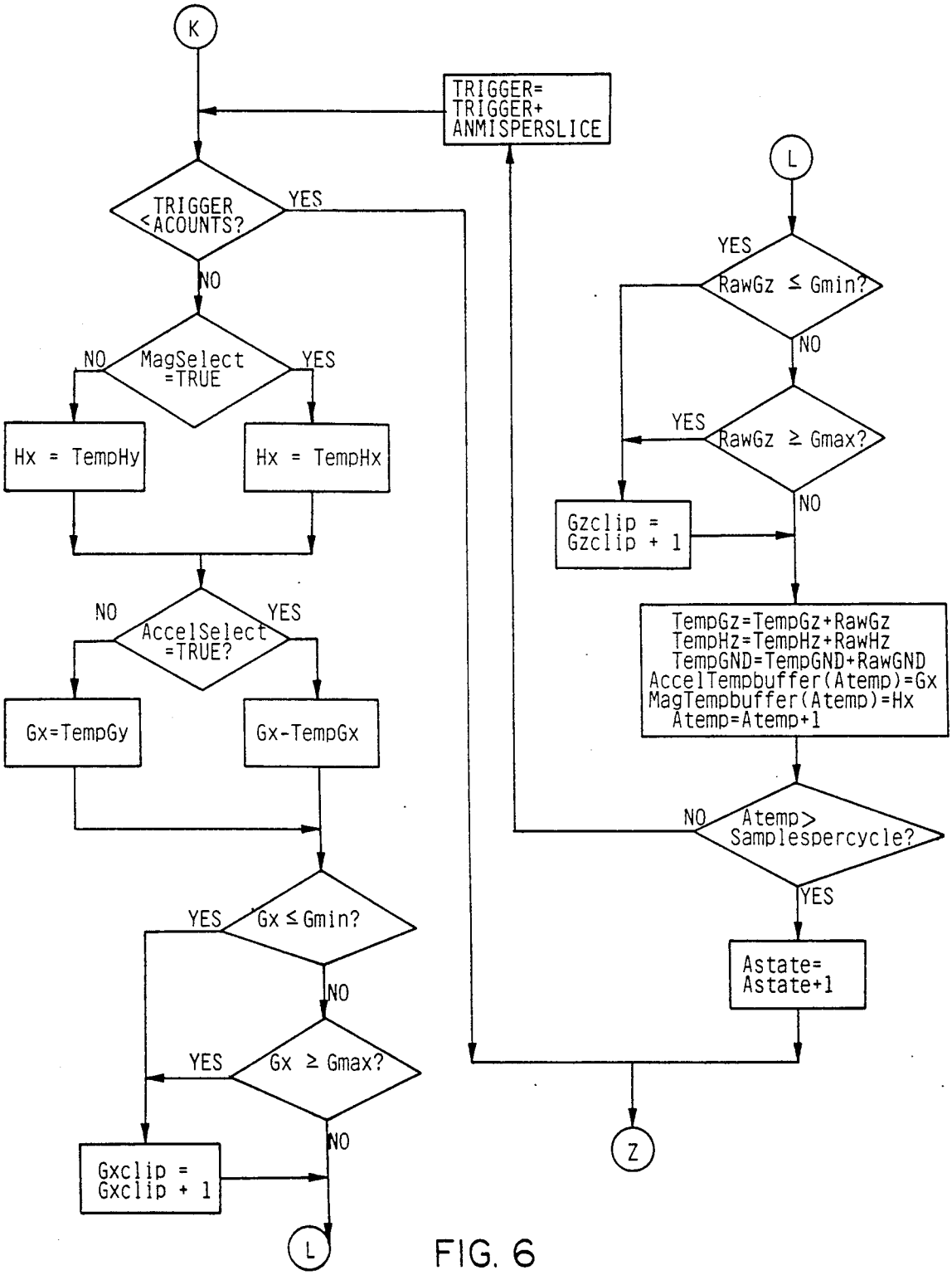
Figure 7:
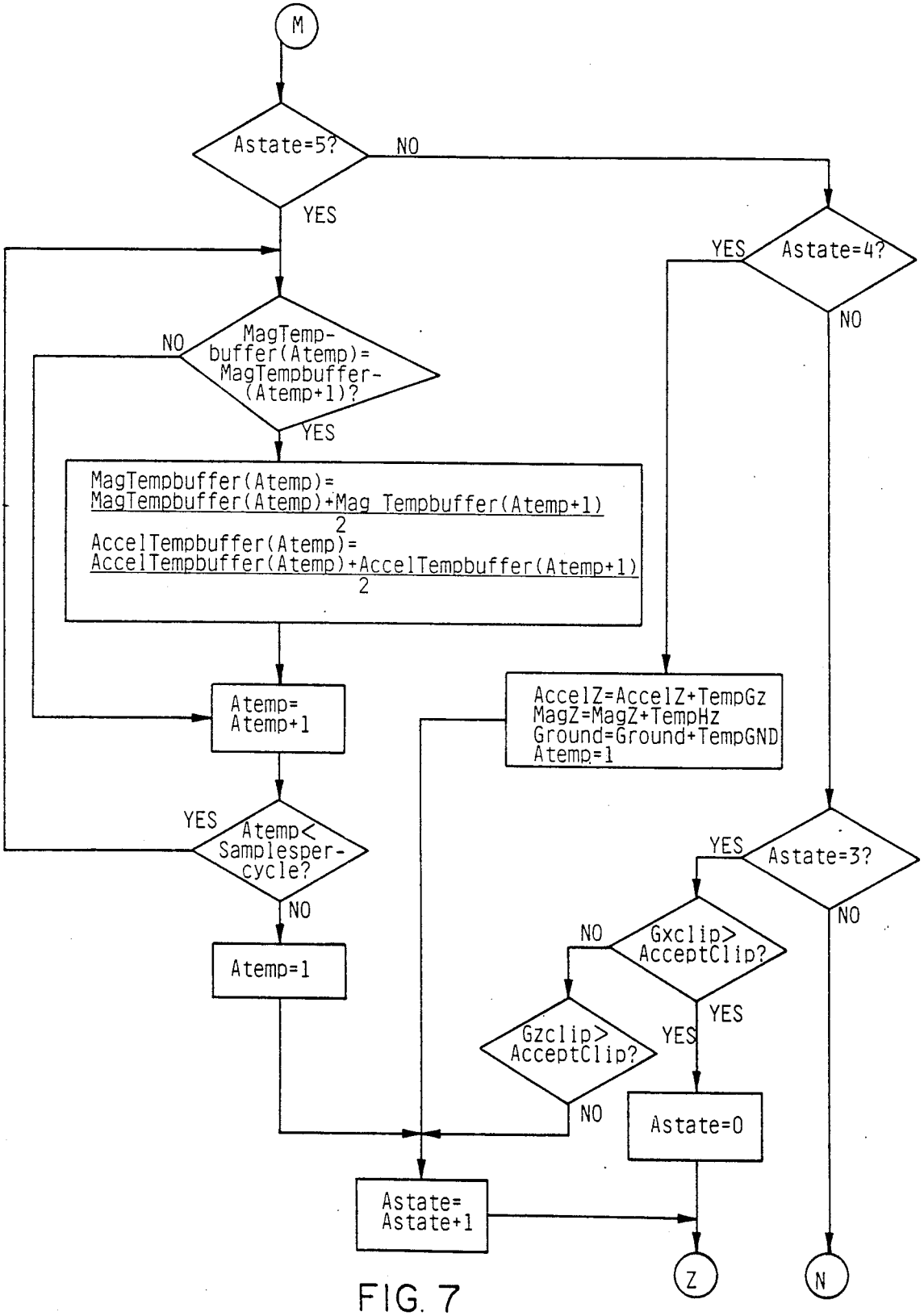

Referring now to FIGS. 6 and 7, the individual samples are stored separately and two tests are conducted before the data is accepted. First, the actual number of samples taken in the last cycle is compared to the desired number and if the difference exceeds an adjustable threshold, the data is discarded. Next, the accelerometer data is scanned and if the number of samples exceeding the system's dynamic range limit is more than some predefined acceptable limit, the data is discarded.

Figure 8:
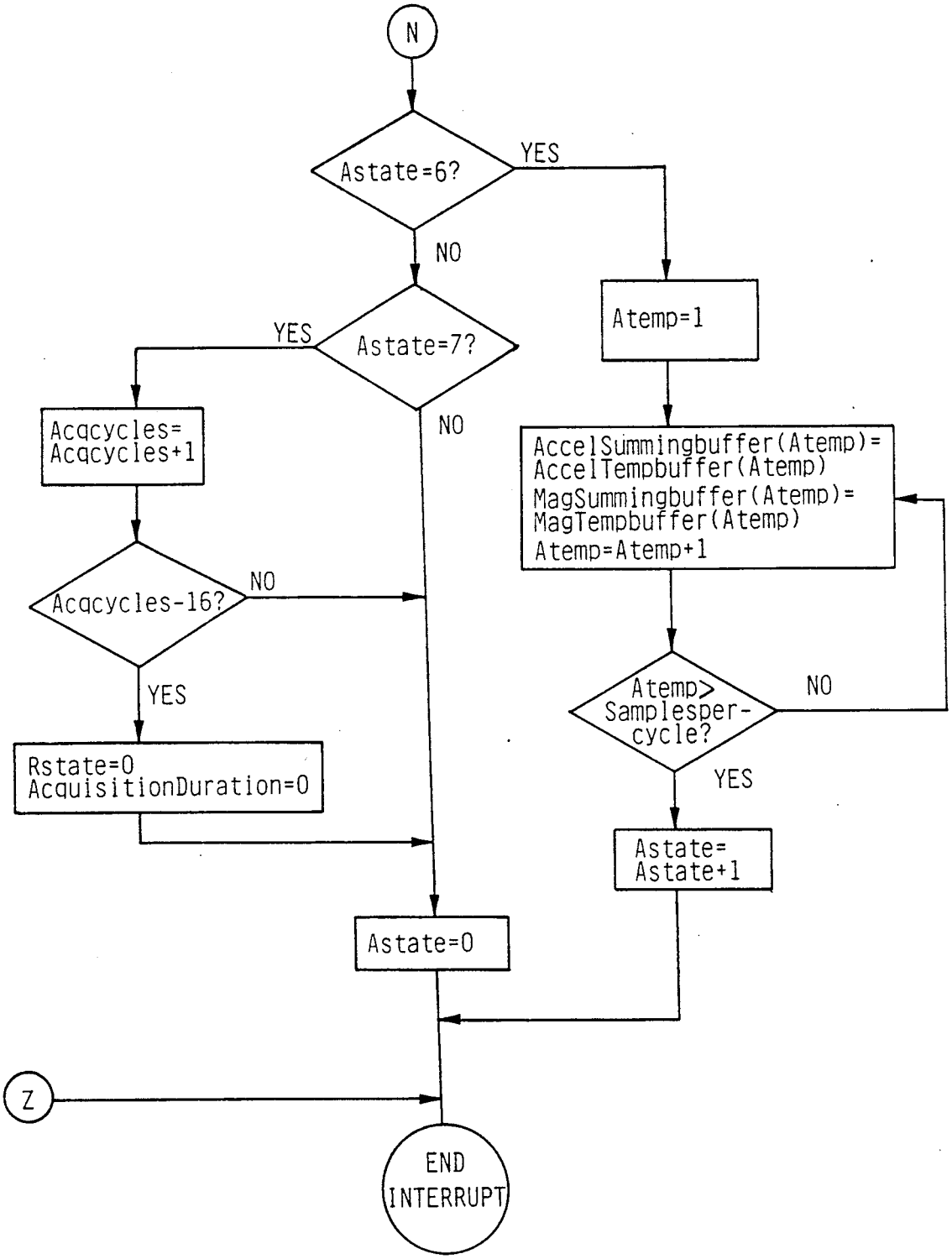

Now referring to FIG. 8, if the data is acceptable, each point is summed into its own accumulation buffer. By summing the data from successive cycles, the data is time averaged to reduce the magnitude of non synchronous noise.

At the conclusion of the acquisition, the summed samples of hx and gx (generally called x(n)) are used to determined the discrete fourier coefficients of the fundamental (see FIG. 11) using the definition of the discrete fourier transform (DFT).

Figure 9:
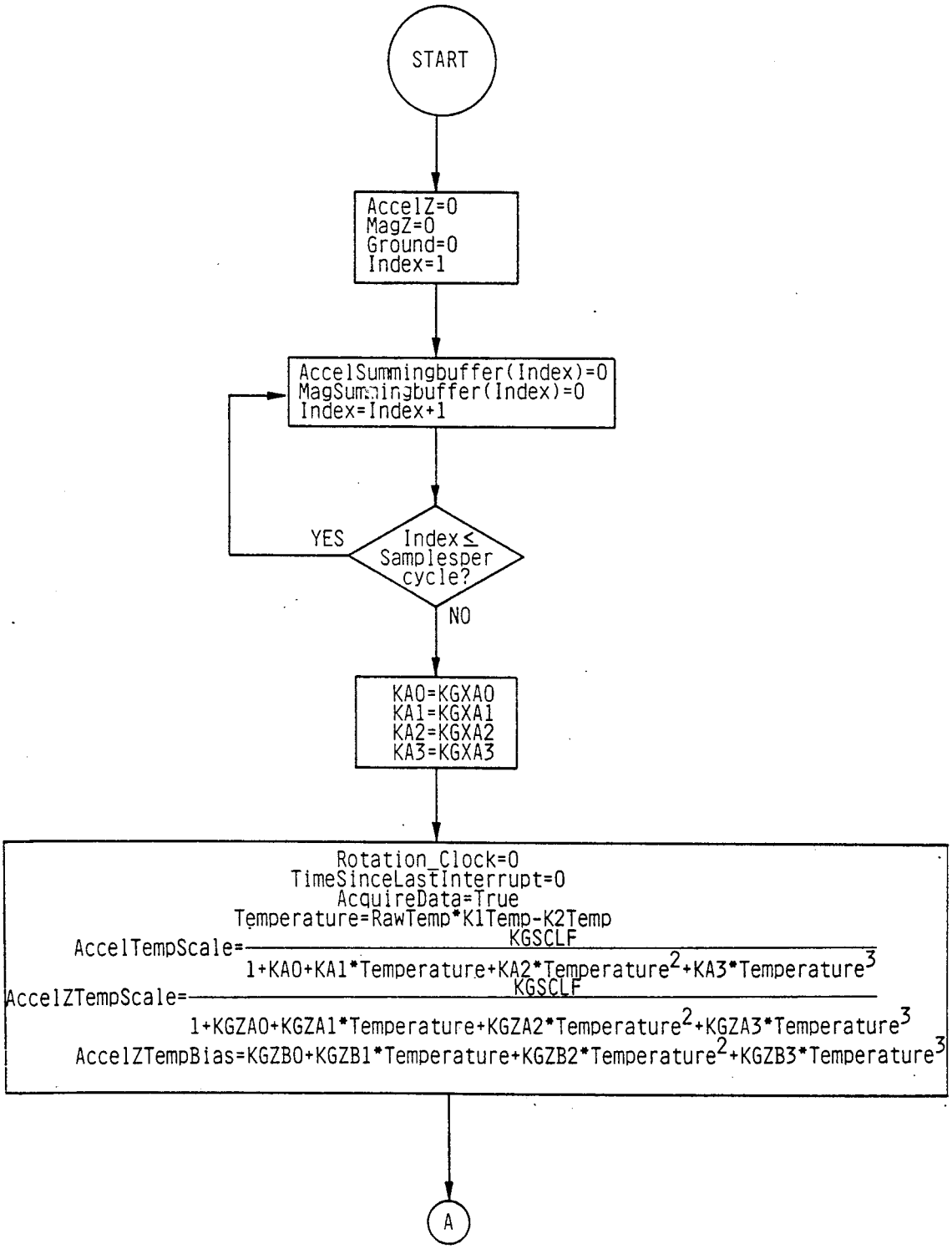
Figure 10:
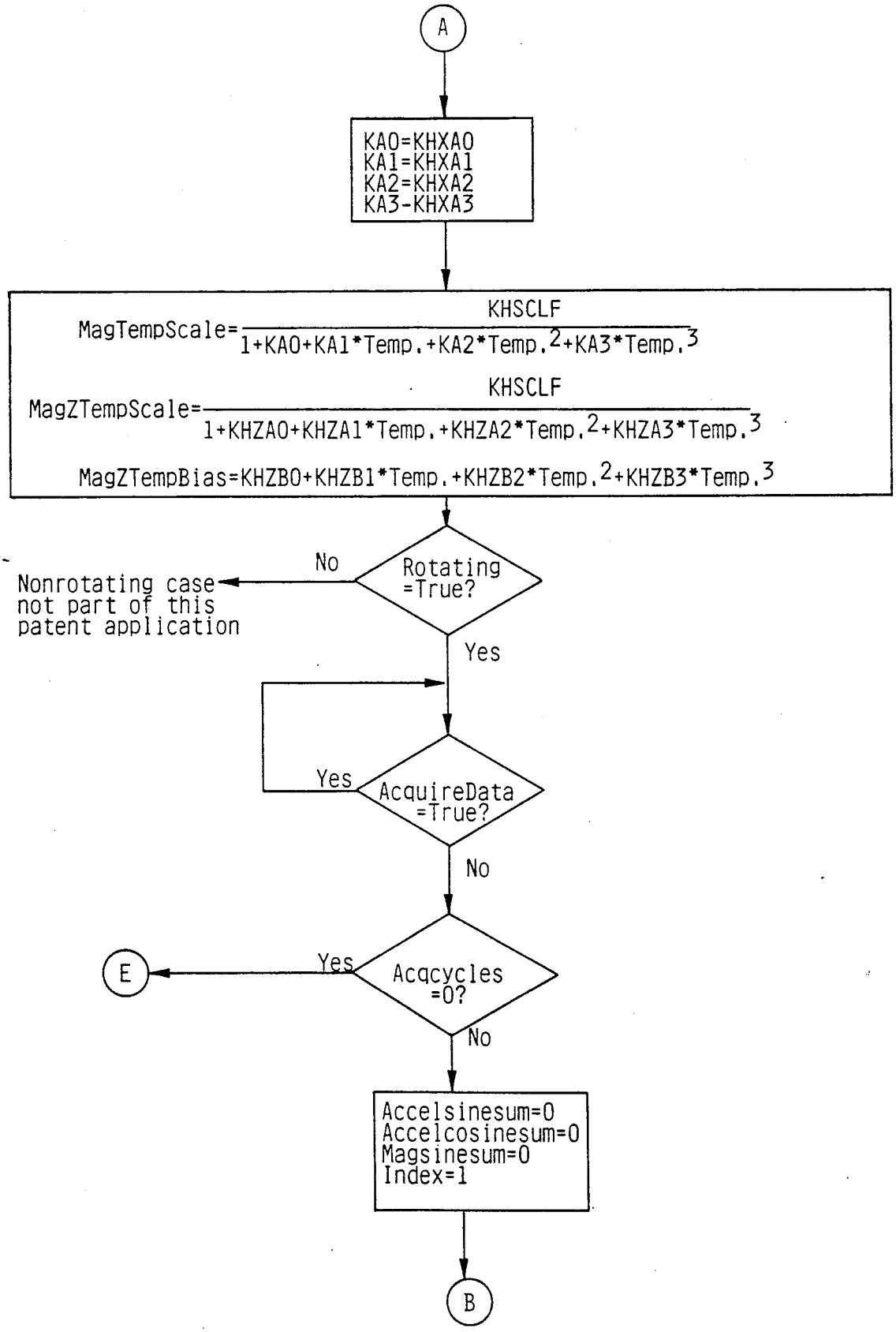
Figure 11:
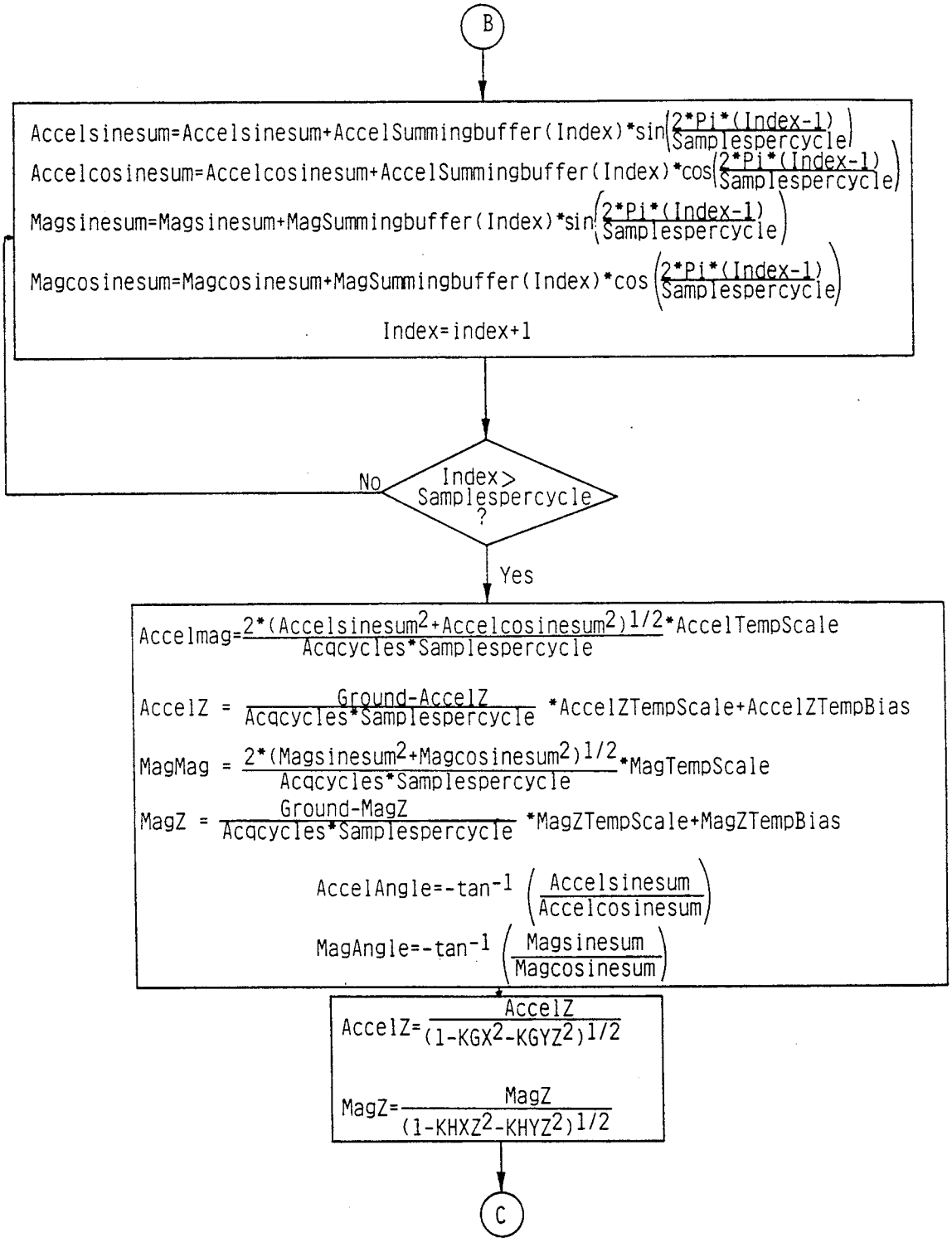
Figure 12:
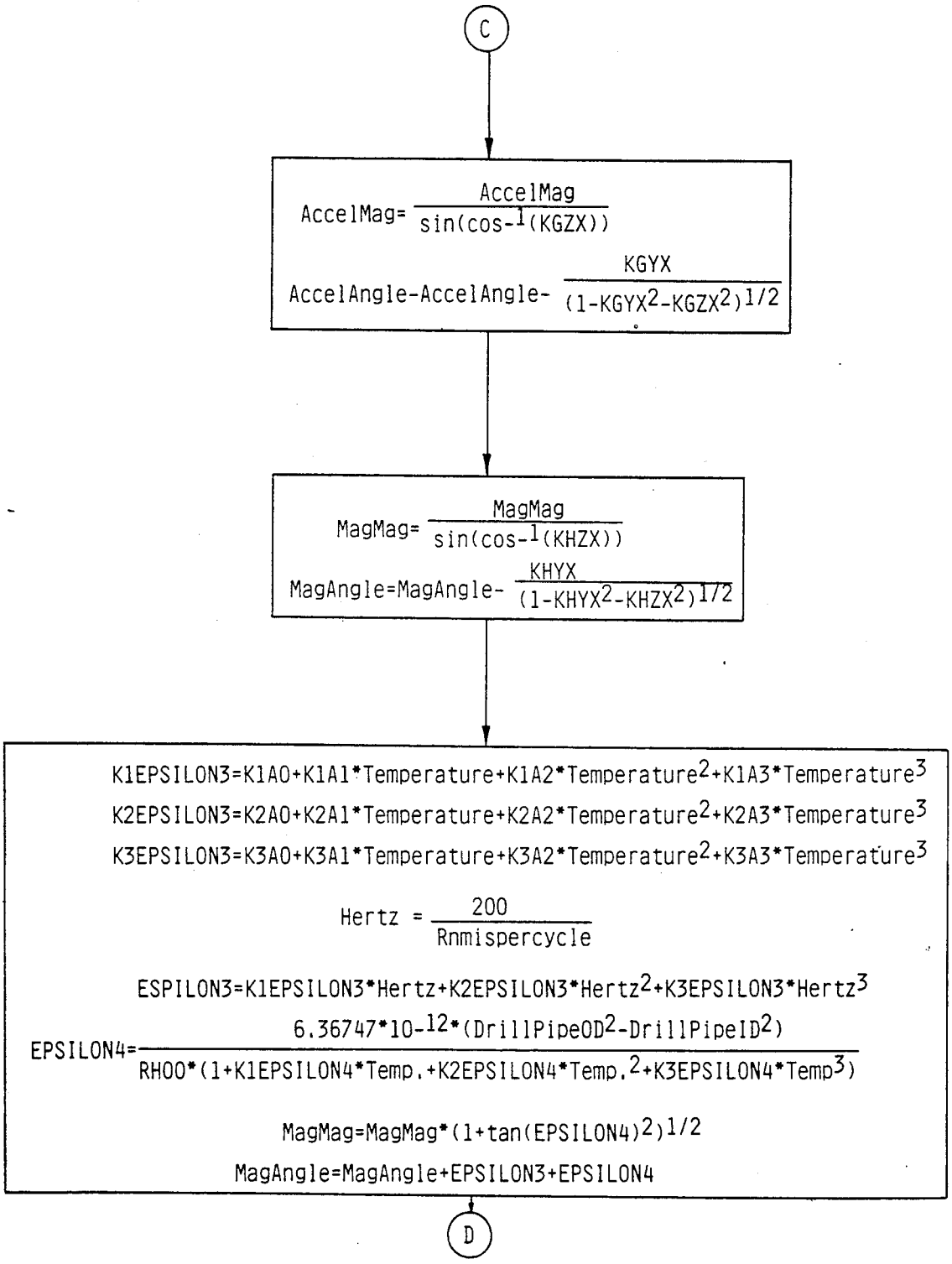
Figure 13:
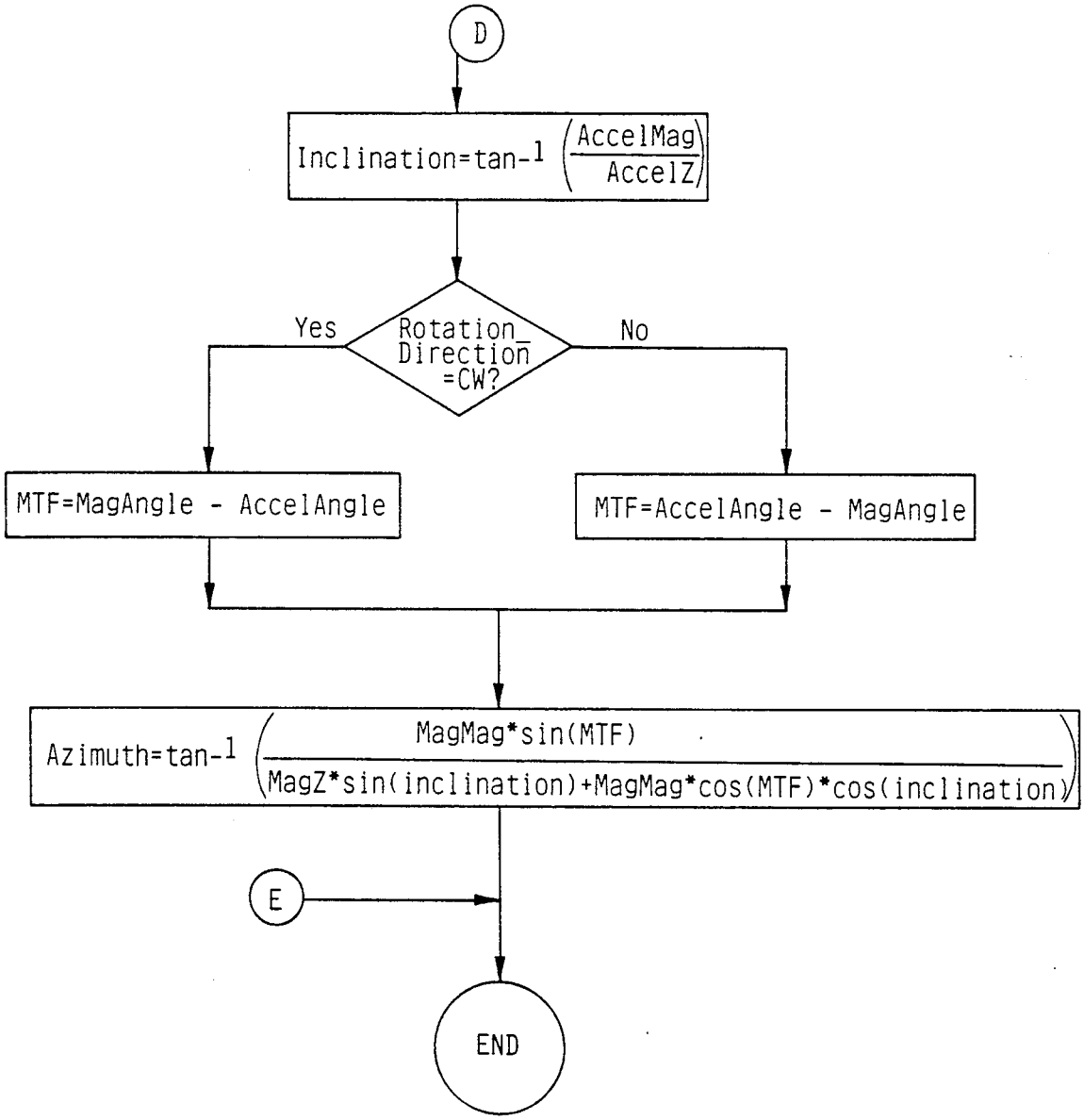

Turning now to the Main Acquisition and Calculation routine of FIGS. 9–13, the temperature corrections for the magnetometer and accelerometer sensor are calculated (FIGS. 9 and 10). Next, as shown in FIG. 11, the DFT's are determined to provide Hx, Gx, Hz and Gz. Hx, Gx, Hz and Gz are then normalized, temperatures corrected and misalignment corrected as shown in FIGS. 11 and 12.

It is generally understood that in addition to the errors due to temperature and sensor misalignment, the dynamic response of the gx and hx sensors and associated acquisition channels could introduce additional amplitude and phase errors. For gx, the errors have two potential sources: (1) The frequency response of the accelerometer and (2) the frequency response of the channel electronics.

The accelerometer used in a preferred embodiment is a type QA-1300 manufactured by Sundstrang Data Control. Inc. The frequency response of this accelerometer is flat to greater than 300 Hz. This is sufficiently above the nominal 2 to 3 Hz of tool rotation such that its effects can be neglected. The electronics channel can be designed with a frequency cut off high enough to allow its effects to be neglected as well.

The hx signal is influenced by the sensor frequency response, the electronics channel frequency response, the sensor housing frequency response and the drill collar frequency response. The electronics channel can be neglected by designing it with a high enough cut-off frequency as discussed for the accelerometer channel. Further, the magnetometer and accelerometer channels frequency response can be matched to further reduce residual phase errors.

The sensor contained in an electrically conductive housing has a frequency response which cannot be neglected. The preferred embodiment of this invention incorporates equations describing the variation of $\phi$ and $|Hx|$ with frequency and temperature. These variations are determined by conventional calibration techniques with curve fitting techniques applied to the resulting data. The effect of the conductive drill collar is also non-negligible. Its effect can be determined by calibration. However, the preferred embodiment of this invention corrects the error by estimating the errors using the following equations:

$$\epsilon = \tan^{-1}\left[\frac{\mu_0\omega(OD^2 - ID^2)}{16R}\right] \tag{2}$$

where $\mu_0$ = Free space permeability.
$\omega$ = Tool rotation rate in radians/sec.
OD = Drill collar outside diameter.
ID = Drill collar inside diameter.
R = Drill collar material resistivity in OHM-meters (usually temperature dependent).

The magnitude $|Hx|$ is reduced by a factor A calculated as:

$$A = \left[\frac{1}{1 + \tan^2(\epsilon)}\right]^{\frac{1}{2}} \tag{3}$$

All of the above discussed error corrections are shown in FIG. 12. Having corrected the data to compensate for error, the rotating azimuth calculation can now be performed.

Rotating azimuth (Az) can then be determined as follows:

$$\text{Azimuth} = \tan^{-1}\left[\frac{\sin(\theta)\sin(\phi)}{\sin(\text{inc})\cos(\theta) + \cos(\text{inc})\sin(\theta)\cos(\phi)}\right] \tag{4}$$

where INC = angle between the tool axis and vertical (e.g. earth's gravity vector); and can be calculated as:

$$\tan^{-1}\left[\frac{|Gx|}{Gz}\right] \tag{5}$$

$|Gx|$ = Magnitude of the first DFT coefficient of gx(t) sampled KN times at an adjusted rate of N samples per revolution over K tool rotations $$= (Re(Gx)^2 + Im(Gx)^2)^{\frac{1}{2}} \tag{6}$$

Gz = Time average of gz(t) over K tool rotations $$Gz = \frac{1}{KN}\sum_{n=0}^{N-1}\sum_{m=0}^{K-1} gz\left((n + m.N)\frac{Tm}{N}\right) \tag{7}$$

$\theta$ = The angle between the tool axis and the earth's magnetic field vector and can be calculated as:

$$\tan^{-1}\left[\frac{|Hx|}{Hz}\right] \tag{8}$$

$|Hx|$ = Magnitude of the first DFT coefficient of hx(t) sampled N times at an adjusted rate of N samples per revolution over K tool rotations $$= (Re(Hx)^2 + Im(Hx)^2)^{\frac{1}{2}} \tag{9}$$

Hz = Time average of hz(t) over K tool rotations $$Hz = \frac{1}{KN}\sum_{n=0}^{N-1}\sum_{m=0}^{K-1} hz\left((n + m.N)\frac{Tm}{N}\right) \tag{10}$$

$\phi$ = Phase angle between the fundamental frequency component of hx(t) and that of gx(t) and can be calculated as:

$$\tan^{-1}\left[\frac{Im(Hx)}{Re(Hx)}\right] - \tan^{-1}\left[\frac{Im(Gx)}{Re(Gx)}\right] \tag{11}$$

Equation 11 is used for clockwise rotation. Equation 11 would be multiplied by (=1) for counterclockwise rotation.

$$Hx = \frac{2e^{i\epsilon}}{AKN}\sum_{n=0}^{N-1}\sum_{m=0}^{K-1} hx\left((n + m.N)\frac{Tm}{N}\right)e^{-\frac{i2\pi n}{N}} \tag{12}$$

$$Gx = \frac{2}{KN}\sum_{n=0}^{N-1}\sum_{m=0}^{K-1} gx\left((n + m.N)\frac{Tm}{N}\right)e^{-\frac{i2\pi n}{N}} \tag{13}$$

Tm = Period for m'th tool rotation.
N = Number of samples taken in one rotation.
K = Number of tool rotations.

Equivalent equations to Equation 4 for calculating Azimuth are:

$$\text{Azimuth} = \tan^{-1}\left[\frac{\sin(\phi)}{\sin(\text{inc})\cot(\theta) + \cos(\text{inc})\cos(\phi)}\right] \quad (14)$$

$$\text{Azimuth} = \tan^{-1}\left[\frac{\sin(\phi)}{\sin(\text{inc})\frac{Hz}{|Hx|} + \cos(\text{inc})\cos(\phi)}\right] \quad (15)$$

$$\text{Azimuth} = \tan^{-1}\left[\frac{|Hx|\sin(\phi)}{Hz\sin(\text{inc}) + |Hx|\cos(\text{inc})\cos(\phi)}\right] \quad (16)$$

In addition to Equations 4, 14, 15 and 16 and in accordance with the present invention, rotating azimuth may also be calculated using Discrete Fourier Transformations of the sample data in the following known Equation 17 (which is the equation used in calculating azimuth in the non-rotating case as discussed in the previously mentioned article by J. L. Marsh). It will be appreciated that Equations 4, 14, 15 and 16 are actually derived from Equation 17.

$$\text{Azimuth} = \tan^{-1}\left[\frac{(gyhx - gxhy)(gx^2 + gy^2 + Gz^2)^{\frac{1}{2}}}{(gx^2 + gy^2)Hz + Gz(hxgx + hygy)}\right] \quad (17)$$

Equation 17 can be used for calculating the rotating azimuth by substituting the results of the DFT calculations for the variables in Equation 17 as set forth in Table 1:

TABLE 1

| Case | Rotation Direction | Perpendicular Sensor Used: Accel | MAG | Substitution for: gx | gy | hx | hy |
|---|---|---|---|---|---|---|---|
| 1 | CW | x | x | Re(Gx) | −Im(Gx) | Re(Hx) | −Im(Hx) |
| 2 | CW | x | y | Re(Gx) | −Im(Gx) | Im(Hy) | Re(Hy) |
| 3 | CW | y | y | Im(Gy) | Re(Gy) | Im(Hy) | Re(Hy) |
| 4 | CW | y | x | Im(Gy) | Re(Gy) | Re(Hx) | −Im(Hx) |
| 5 | CCW | x | x | Re(Gx) | Im(Gx) | Re(Hx) | Im(Hx) |
| 6 | CCW | x | y | Re(Gx) | Im(Gx) | −Im(Hy) | Re(Hy) |
| 7 | CCW | y | y | −Im(Gy) | Re(Gy) | −Im(Hy) | Re(Hy) |
| 8 | CCW | y | x | −Im(Gy) | Re(Gy) | Re(Hx) | Im(Hx) |

Note that for Gz, use Equation 7; and for Hz use Equation 10 where Hx and Gx are defined in Equations 12–13, respectively and where Hy and Gy are defined as follows:

$$Hy = \frac{2e^{i\epsilon}}{AKN}\sum_{n=0}^{N-1}\sum_{m=0}^{K-1} hy\left((n + m.N)\frac{Tm}{N}\right)e^{-\frac{i2\pi n}{N}} \quad (18)$$

$$Gy = \frac{2}{KN}\sum_{n=0}^{N-1}\sum_{m=0}^{K-1} gy\left((n + m.N)\frac{Tm}{N}\right)e^{-\frac{i2\pi n}{N}} \quad (19)$$

It will be appreciated that all the information necessary to determine azimuth while rotating is contained in either the x or y sensors. The above Table 1 reflects this equivalence. It will be further appreciated that while Equations 4 and 14–16 have been discussed in terms of the x sensor, these equations are similarly valid using the y sensor and Equations 18 and 19. However, for the sake of simplicity and to avoid redundancy, the y sensor equations have not been shown.

The actual computer software which can be used to practice the above described method of calculating azimuth of a borehole while drilling is depicted in the flow charts of FIGS. 2–13. The several flow chart variables, initial state assumptions and constants are defined in TABLES 2–4 below. An example of actual source code written in Motorola 68000 assembly language for implementing the method of FIGS. 2–13 is attached hereto as a Microfiche Appendix. The flow charts of FIGS. 2–13 will be easily and fully comprehended and understood by those of ordinary skill. For ease of discussion, the flow charts of FIGS. 2–13 utilize Equation 16 to determine azimuth. However, it will be appreciated that any one of Equations 4, 14, 15 and the substituted Equation 17 may be used in the flow charts.

TABLE 2

FLOW CHART VARIABLES

| VariableDescription | |
|---|---|
| AccelAngle | Angle of the Acceleromoter 'X' or 'Y' axis. |
| Accelcosinesum | Temporary storage of the DFT calculated cosine sum. |
| AccelMag | Magnitude of the Accelerometer 'X' or 'Y' axis. |
| AccelSelect | True if AccelMag and AccelAngle represent 'X' axis values. False if AccelMag and AccelAngle represent 'Y' axis values. |
| Accelsinesum | Temporary storage of the DFT calculated sine sum. |
| AccelSummingbuffer | An array dimensioned to Samplespercycle which contains the summed Accelerometer 'X' or 'Y' axis A/D data. |
| AccelTempBias | A temporary variable which is an intermediate value which converts accelerometer X or Y axis A/D bits into temperature corrected units of gravities. |
| AccelTempBuffer | An arrary dimensioned to Samplespercycle which contains the Accelerometer 'X' or 'Y' axis A/D data. |
| AccelTempScale | A temporary variable which is an intermediate value which converts accelerometer X or Y axis A/D bits into temperature corrected units of gravities. |
| AccelZTempBias | A temporary variable which converts accelerometer Z axis A/D bits into temperature corrected units of gravities. |
| AccelZTempScale | A temporary variable which converts accelerometer Z axis A/D bits into temperature corrected units of gravities. |
| AccelZ | Magnitude of the Accelerometer 'Z' axis. |
| AcceptClip | The acceptable number of Samplespercycle data sets that can experience clipping and still be acceptable for inclusion of this rotation in the final analysis. |
| Accounts | The number of executions of the interrupt routine during this revolution of the downhole tool. |
| Acqcycles | Number of tool revolutions over which the raw Magnetometer and Accelerometer data was acquired. |
| AcquireData | Executes the interrupt routine when True (Performs rotating data acquisition). Bypasses the interrupt routine when False. |
| AcquisitionDuration | The amount of time over which the rotating azimuth and inclination raw data is acquired. |
| Anmisperslice | The ratio of the actual number of interrupt routine executions per revolution to the desired number used in the Astate machine. |
| Astate | One of two state machines in the interrupt routine which acquires the data that is later used for the calculation of rotating azimuth and inclination. |
| Atemp | Loop index used in the Astate machine. |
| Azimuth | 0 to 360 degrees from magnetic north. |
| DrillpipeID | Inside diameter of the drill pipe of the downhole tool. |
| DrillpipeOD | Outside diameter of the drill pipe of the downhole tool. |

-continued

| | |
|---|---|
| EPSILON3 | Variable which contains the phase error corrections associated with rotation. |
| EPSILON4 | Variable which contains the magnitude corrections associated with rotation. |
| GMAX | The A/D raw reading which if a raw accelerometer reading is equal or greater than constitutes clipping. |
| GMIN | The A/D raw reading which if a raw accelerometer reading is equal or less than constitutes clipping. |
| Ground | Magnitude of the ground signal in the same scaling as AccelZ and magZ. |
| GX | Temporary variable used to store either TempGx or TempGy based upon AccelSelect. |
| Gxclip | The number of Samplespercycle data sets that have experience clipping on the X or Y accelerometer axis. Whichever is specified by AccelSelect. |
| Gzclip | The number of Samplespercycle data sets that have experience clipping on the Z accelerometer axis. |
| HX | Temporary variable used to store either TemHx or TempHy based upon MagSelect. |
| Inclination | 0 to 90 degrees from line which points to center of the earth. |
| Index | Loop counter temporary variable. |
| KA0-KA3 | Temporary variables used to represent KGXA0-KGXA3, KGYA0-KGYA3, KHXA0-KHXA3, KHYA0-KHYA3 to reduce the number of equations that have to be coded. |
| KB0-KB3 | Temporary variables used to represent KGXB0-KGXB3, KGYA0-KGYA3, KHYA0-KHYA3 to reduce the number of equations that have to be coded. |
| KGSCLF | Constant used to scale accelerometer A/D bits into units of gravities. |
| KGXA0-KGXA3 | Constants used to temperature correct the accelerometer X axis. |
| KGXB0-KGXB3 | Constants used to temperature correct the accelerometer X axis. |
| KGYA0-KGYA3 | Constants used to temperature correct the accelerometer Y axis. |
| KGYB0-KGYB3 | Constants used to temperature correct the accelerometer Y axis. |
| KGZA0-KGZA3 | Constants used to temperature correct the accelerometer Z axis. |
| KGZB0-KGZB3 | Constants used to temperature correct the accelerometer Z axis. |
| KHSCLF | Constant used to scale magnitometer A/D bits into units of gauss. |
| KHXA0-KHXA3 | Constants used to temperature correct the magnetometer X axis. |
| KHXB0-KHXB3 | Constants used to temperature correct the magnetometer X axis. |
| KHYA0-KHYA3 | Constants used to temperature correct the magnetometer Y axis. |
| KHYB0-KHYB3 | Constants used to temperature correct the magnetometer Y axis. |
| KHZA0-KHZA3 | Constants used to temperature correct the magnetometer Z axis. |
| KHZB0-KHZB3 | Constants used to temperature correct the magnetometer Z axis. |
| K1A0-K1A3 | Constants used to temperature correct the constant K1EPSILON3 |
| K1EPSILON3 | Constant used to frequency correct the variable EPSILON3. |
| K1EPSILON4 | Constant used to frequency correct the variable EPSILON4. |
| K1Temp | Constant used to convert the raw A/D input for temperature into degrees centigrade. |
| K2A0-K2A3 | Constants used to temperature correct the constant K2EPSILON3 |
| K2EPSILON3 | Constant used to frequency correct the variable EPSILON3. |
| K2EPSILON4 | Constant used to frequency correct the variable EPSILON4. |
| K2Temp | Constant used to convert the raw A/D input for temperature into degrees centigrade. |
| K3A0-K3A3 | Constants used to temperature correct the constant K3EPSILON3 |
| K3EPSILON3 | Constant used to frequency correct the variable EPSILON3. |
| K3EPSILON4 | Constant used to frequency correct the variable EPSILON4. |
| Last-Quadrant | Value of Quadrant during the last execution of the interrupt routine. |
| MagAngle | Angle of the Accelerometer "X" or "Y". |
| Magcosinesum | Temporary storage of the DFT calculated cosine sum. |
| MagMag | Magnitude of the Magnetometer "X" or "Y" axis. |
| MagSelect | True if MagMag and MagAngle represent the "X" axis. False if MagMag and MagAngle represent the "Y" axis. |
| Magsinesum | Temporary storage of the DFT calculated sine sum. |
| MagSumminbuffer | An array dimensioned to Samplespercycle which contains the Magnetometer "X" or "Y" axis A/D data. |
| MagTempBias | A temporary variable which is an intermediate value which converts magnetometer X or Y axis A/D into temperature corrected units or gauss. |
| MagTempbuffer | An array dimensioned to Samplespercycle which contains the Magnetometer "X" or "Y" axis A/D data. |
| MagTempScale | A temporary variable which is an intermediate value which converts magnetometer X or Y axis A/D into temperature corrected units of gauss. |
| MagZTempBias | A temporary variable which converts magnetometer Z axis A/D bits into temperature corrected units of gauss. |
| MagZTempScale | A temporary variable which converts magnetometer Z axis A/D bits into temperature corrected units of gauss. |
| MAGZ | Magnitude of Magnetometer "Z" axis. |
| MTF | Magnetic Tool Face is the angle between the magnetometer and accelerometer angles. |
| Pi | 3.14159 . . . etc. |
| RawTemp | Actual A/D reading for temperature. |
| RCounts | The number of interrupt routine executions in a complete revolution of the downhole tool. |
| Rotation-Clock | A value between 0 and 12 seconds. It is the interval over which a check is made if the tool is rotating. |
| Rotation-Detection | The number of consecutive quadrants that the tool has rotated in the same direction. If positive then the direction was clockwise. If negative then the direction was counterclockwise. |
| Rotation-Detection | If the tool is rotating then this variable is either CW for clockwise or CCW for counterclockwise. |
| Rotation-SetPoint | The number of consecutive quadrant changes in the same rotation direction that constitute the declaration that the tool is rotating. |
| Rotating | True if the tool is rotating about its Z axis. False if it is not rotating about its Z axis. |
| Rnmispercycle | The number of interrupt routine executions in a complete revolution of the downhole tool. |
| Rnmisperslice | The ratio of the actual number of interupt routine executions per revolution to the desired number. |
| RHO0 | Constant. |
| Rstate | One of two state machines in the interupt routine which determines the length of the rotation period of the downhole tool. |
| Samplespercycle | Number of identical intervals each tool revolution is divided into. Raw Accelerometer and Magnetometer data is acquired at each interval. |
| Temperature | Temperature of the downhole tool in degrees centigrade. |
| TempValid | True if the value of the variable Temper- |

-continued

| | |
|---|---|
| | ature is valid. False if the value of the variable Temperature is invalid. |
| Trigger | Value indicates to take one of the Samplespercycle data sets. |

TABLE 3

INITIAL STATE ASSUMPTIONS

| Variable | Value |
|---|---|
| AcquireData | False |
| AcquisitionDuration | 20 Seconds. |
| DrillPipeID | Diameter of the inside of the drill collar that the downhole tool mounts inside of. |
| DrillPipeOD | Diameter of the outside of the drill collar that the downhole tool mounts inside of. |
| TempValid | False. |

TABLE 4

Constants Which are Determined by Calibration Procedures KGSCLF, KHSCLF, KGXA0-KGXA3, KGXBO-KGXB3, KGYAO-KGYA3, KGYBO-KGYB3, KGZA0-KGZA3, KGZBO-KGZB3, KHXA0-KHXA3, KHXB0-KHXB3, KHYAO-KHYA3, KHYBO-KHYB3, KHZA0-KHZA3, KHZB0-KHZB3, K1A0-K1A3, K2A0-K2-A3, K3A0-K3A3, K1Tempm K2Temp While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method for determining the azimuth angle of a borehole being drilled by instruments contained downhole in a tool in the drillstring, including the steps of:

rotating the drillstring;

sensing with accelerometer means while the drillstring is rotating the instantaneous acceleration components of gx and gz at the location of the tool;

sensing with magnetometer means while the drillstring is rotating the instantaneous magnetic field components of hx and hz at the location of the tool wherein the components gz and hz are along the axis of the drillstring, the component gx being orthogonal to gz and the component hx being orthogonal to hz;

determining the rotation rate of the drillstring;

determining the direction of the rotation of the drillstring;

determining azimuth angle from at least one of the equivalent relationships $$\text{Azimuth} = \tan^{-1}\left[\frac{\sin(\theta)\sin(\phi)}{\sin(inc)\cos(\theta) + \cos(inc)\sin(\theta)\cos(\phi)}\right]$$

$$\text{Azimuth} = \tan^{-1}\left[\frac{\sin(\phi)}{\sin(inc)\cos(\theta) + \cot(inc)\cos(\phi)}\right]$$

$$\text{Azimuth} = \tan^{-1}\left[\frac{\sin(\phi)}{\sin(inc)\frac{Hz}{|Hx|} + \cos(inc)\cos(\phi)}\right]$$

-continued $$\text{Azimuth} = \tan^{-1}\left[\frac{|Hx|\sin(\phi)}{Hz\sin(inc) + |Hx|\cos(inc)\cos(\phi)}\right]$$

where $\theta$ = the angle between the tool axis and the earth's magnetic field vector which is determined as a function of |Hx| and Hz;

$\phi$ = the phase angle between the fundamental frequency component hx and gx;

INC = the angle between the tool axis and the earth's gravity vector which is determined as a function of |Gx| and Gz;

Hz = the time average of hz;

|Hx| = the magnitude of the first discrete fourier transform coefficient of hx; and

|Gx| = the magnitude of the first discrete fourier transform coefficient of gx.

2. The method of claim 1 including the step of: determining $\theta$ from the equation $$\tan^{-1}\left[\frac{|Hx|}{Hz}\right]$$

3. The method of claim 1 including the step of: determining $\phi$ from the equation $$\tan^{-1}\left[\frac{Im(Hx)}{Re(Hx)}\right] - \tan^{-1}\left[\frac{Im(Gx)}{Re(Gx)}\right]$$

where $$Hx = \frac{2e^{i\epsilon}}{AKN}\sum_{n=0}^{N-1}\sum_{m=0}^{K-1} hx\left((n + mN)\frac{Tm}{N}\right)e^{-\frac{i2\pi n}{N}}$$

$$Gx = \frac{2}{KN}\sum_{n=0}^{N-1}\sum_{m=0}^{K-1} gx\left((n + mN)\frac{Tm}{N}\right)e^{-\frac{i2\pi n}{N}}$$

Tm = period for m'th tool rotation;

N = number of samples taken in one rotation;

K = number of tool rotations; and $\epsilon$ and A = correction factors for error caused by a conductive drill collar.

4. The method of claim 1 including the step of: determining INC from the equation $$\tan^{-1}\left[\frac{|Gx|}{Gz}\right]$$

where

Gz = the time average of gz.

5. The method of claim 4 including the step of: determining |Gz| from the equation:

$$= (Re(Gx)^2 + Im(Gx)^2)^{\frac{1}{2}}$$

where

Tm = period for the m'th tool rotation;

N = number of samples taken in one rotation; and k = number of tool rotations.

6. The method of claim 4 including the step of: determining Gz from the equation $$Gz = \frac{1}{KN} \sum_{n=0}^{N-1} \sum_{m=0}^{K-1} gz\left((n + mN)\frac{Tm}{N}\right)$$

where

K=number of tool rotations;

N=number of samples taken in one rotation; and

Tm=period of the m'th tool rotation.

7. The method of claim 1 including the step of: determining |Hx| from the equation $$=(Re(Hx)^2+Im(Hx)^2)^{\frac{1}{2}}$$

where

Tm=period for the m'th tool rotation;

N=number of samples taken in one rotation;

K=number of tool rotations; and $\epsilon$ and A=correction factors for error caused by a conductive drill collar.

8. The method of claim 1 including the step of: determining Hz from the equation $$Hz = \frac{1}{KN} \sum_{n=0}^{N-1} \sum_{m=0}^{K-1} hz\left((n + mN)\frac{Tm}{N}\right)$$

where

K=number of tool rotations;

N=number of samples taken in one rotation; and

Tm=period of the m'th tool rotation.

9. The method of claim 1 including the step of: correcting the error caused by a conductive drill collar using the equation:

$$\epsilon = \tan^{-1}\left[\frac{\mu_0\omega(OD^2 - ID^2)}{16R}\right]$$

where $\mu_0$=free space permeability $\omega$=tool rotation rate

OD=drill collar outside diameter

ID=drill collar inside diameter

R=drill collar material resistivity.

10. The method of claim 9 including the step of: correcting error in the magnitude |Hx| using the equation $$A = \left[\frac{1}{1 + \tan^2(\epsilon)}\right]^{\frac{1}{2}}$$

11. A method for determining the azimuth angle of a borehole being drilled by instruments contained downhole in a tool in the drillstring, including the steps of:

rotating the drillstring;

sensing with accelerometer means while the drillstring is rotating the instantaneous acceleration components of gx or gy and gz at the location of the tool;

sensing with magnetometer means while the drillstring is rotating the instantaneous magnetic field components of hx or hy and hz at the location of the tool wherein the components gz and hz are along the axis of the drillstring, the components gx and gy are orthogonal to gz and the components hx and hy are orthogonal to hz;

determining the rotation rate of the drillstring;

determining the direction of the rotation of the drillstring;

determining azimuth angle from the relationship $$\text{Azimuth} = \tan^{-1}\left[\frac{(gyhx - gxhy)(gx^2 + gy^2 + Gz^2)^{\frac{1}{2}}}{(gx^2 + gy^2)Hz + Gz(hxgx + hygy)}\right]$$

where gx, gy, hx and hy are substituted with respect to rotation direction and orthogonal sensor as follows:

| Rotation | Orthogonal Sensor Used | | Substitution for: | | | |
|---|---|---|---|---|---|---|
| Direction | Accel | MAG | gx | gy | hx | hy |
| Clockwise | x | x | Re(Gx) | −Im(Gx) | Re(Hx) | −Im(Hx) |
| Clockwise | x | y | Re(Gx) | −Im(Gx) | Im(Hy) | Re(Hy) |
| Clockwise | y | y | Im(Gy) | Re(Gy) | Im(Hy) | Re(Hy) |
| Clockwise | y | x | Im(Gy) | Re(Gy) | Re(Hx) | −Im(Hx) |
| Counter CW | x | x | Re(Gx) | Im(Gx) | Re(Hx) | Im(Hx) |
| Counter CW | x | y | Re(Gx) | Im(Gx) | −Im(Hy) | Re(Hy) |
| Counter CW | y | y | −Im(Gy) | Re(Gy) | −Im(Hy) | Re(Hy) |
| Counter CW | y | x | −Im(Gy) | Re(Gy) | Re(Hx) | Im(Hx) |

where $$Hx = \frac{2e^{i\epsilon}}{AKN} \sum_{n=0}^{N-1} \sum_{m=0}^{K-1} hx\left((n + mN)\frac{Tm}{N}\right)e^{-\frac{i2\pi n}{N}}$$

$$Hy = \frac{2e^{i\epsilon}}{AKN} \sum_{n=0}^{N-1} \sum_{m=0}^{K-1} hy\left((n + mN)\frac{Tm}{N}\right)e^{-\frac{i2\pi n}{N}}$$

$$Gx = \frac{2}{KN} \sum_{n=0}^{N-1} \sum_{m=0}^{K-1} gx\left((n + mN)\frac{Tm}{N}\right)e^{-\frac{i2\pi n}{N}}$$

$$Gy = \frac{2}{KN} \sum_{n=0}^{N-1} \sum_{m=0}^{K-1} gy\left((n + mN)\frac{Tm}{N}\right)e^{-\frac{i2\pi n}{N}}$$

Tm=period of the m'th tool rotation;

N=number of samples taken in one tool rotation;

K=number of tool rotations;

Gz=the time average of gz; and

Hz=the time average of hz.

12. The method of claim 11 including the step of: determining Gz from the equation $$Gz = \frac{1}{KN} \sum_{n=0}^{N-1} \sum_{m=0}^{K-1} gz\left((n + mN)\frac{Tm}{N}\right)$$

13. The method of claim 11 including the step of: determining Hz from the equation $$Hz = \frac{1}{KN} \sum_{n=0}^{N-1} \sum_{m=0}^{K-1} hz\left((n + mN)\frac{Tm}{N}\right)$$

14. The method of claim 11 including the step of: correcting the error caused by a conductive drill collar using the correction factor $$\frac{1}{A} e^{i\epsilon}$$

wherein $$\epsilon = \tan^{-1}\left[\frac{\mu_0\omega(OD^2 - ID^2)}{16R}\right]$$

$$A = \left[\frac{1}{1 + \tan^2(\epsilon)}\right]^{\frac{1}{2}}$$

wherein $\mu_0$=free space permeability $\omega$=tool rotation rate

OD=drill collar outside diameter

ID=drill collar inside diameter

R=drill collar material resistivity.

15. An apparatus for determining the azimuth angle of a borehole being drilled by instruments contained downhole in a tool in the drillstring, including:

means for rotating the drillstring;

accelerometer means for sensing while the drillstring is rotating the instantaneous acceleration components of gx and gz at the location of the tool;

magnetometer means for sensing while the drillstring is rotating the instantaneous magnetic field components of hx and hz at the location of the tool wherein the components gz and hz are along the axis of the drillstring, the component gz being gy are orthogonal to gz and the component hx being orthogonal to hz;

means for determining the rotation rate of the drillstring;

means for determining the direction of the rotation of the drillstring;

means for determining azimuth angle from at least one of the equivalent relationships $$\text{Azimuth} = \tan^{-1}\left[\frac{\sin(\theta)\sin(\phi)}{\sin(inc)\cos(\theta) + \cos(inc)\sin(\theta)\cos(\phi)}\right]$$

$$\text{Azimuth} = \tan^{-1}\left[\frac{\sin(\phi)}{\sin(inc)\cot(\theta) + \cos(inc)\cos(\phi)}\right]$$

$$\text{Azimuth} = \tan^{-1}\left[\frac{\sin(\phi)}{\sin(inc)\frac{Hz}{|Hx|} + \cos(inc)\cos(\phi)}\right]$$

$$\text{Azimuth} = \tan^{-1}\left[\frac{|Hx|\sin(\phi)}{Hz\sin(inc) + |Hx|\cos(inc)\cos(\phi)}\right]$$

where $\theta$=the angle between the tool axis and the earth's magnetic field vector which is determined as a function of |Hx| and Hz;

$\phi$=the phase angle between the fundamental frequency component hx and gx;

INC=the angle between the tool axis and the earth's gravity vector which is determined as a function of |Gz| and Gz;

Hz=the time average of hz;

|Hx|=the magnitude of the first discrete fourier transform coefficient of hx; and

|Gx|=the magnitude of the first discrete fourier transform coefficient of gx.

16. The apparatus of claim 15 including: determining $\theta$ from the equation $$\tan^{-1}\left[\frac{|Hx|}{Hz}\right]$$

17. The apparatus of claim 15 including: determining $\phi$ from the equation $$\tan^{-1}\left[\frac{Im(Hx)}{Re(Hx)}\right] - \tan^{-1}\left[\frac{Im(Gx)}{Re(Gx)}\right]$$

where $$Hx = \frac{2e^{i\epsilon}}{AKN} \sum_{n=0}^{N-1} \sum_{m=0}^{K-1} hx\left((n + mN)\frac{Tm}{N}\right)e^{-\frac{i2\pi n}{N}}$$

$$Gx = \frac{2}{KN} \sum_{n=0}^{N-1} \sum_{m=0}^{K-1} gx\left((n + mN)\frac{Tm}{N}\right)e^{-\frac{i2\pi n}{N}}$$

Tm=period for the m'th tool rotation;

N=number of samples taken in one rotation;

K=number of tool rotations; and $\epsilon$ and A=correction factors for error caused by a conductive drill collar.

18. The apparatus of claim 15 including: means for determining INC from the equation $$\tan^{-1}\left[\frac{|Gx|}{Gz}\right]$$

where

Gz=the time average of gz.

19. The apparatus of claim 18 including: means for determining |Gx| from the equation:

$$=(Re(Gx)^2 + Im(Gx)^2)^{\frac{1}{2}}$$

where

Tm=period for the m'th tool rotation;

N=number of samples taken in one rotation; and

K=number of tool rotations.

20. The apparatus of claim 18 including: means for determining Gz from the equation $$Gz = \frac{1}{KN} \sum_{n=0}^{N-1} \sum_{m=0}^{K-1} gz\left((n + mN)\frac{Tm}{N}\right)$$

where

K=number of tool rotations;

N=number of samples taken in one rotation; and

Tm=period for the m'th tool rotation.

21. The apparatus of claim 15 including: means for determining |Hx| from the equation $$=(Re(Hx)^2+Im(Hx)^2)^{\frac{1}{2}}$$

where

Tm=period for the m'th tool rotation;

N=number of samples taken in one rotation;

K=number of tool rotations; and $\epsilon$ and A=correction factors for error caused by a conductive drill collar.

22. The apparatus of claim 15 including: means for determining Hz from the equation $$Hz = \frac{1}{KN} \sum_{n=0}^{N-1} \sum_{m=0}^{K-1} hz\left((n + mN)\frac{Tm}{N}\right)$$

where

K=number of tool rotations;

N=number of samples taken in one rotation; and

T=period for the m'th tool rotation.

23. The apparatus of claim 15 including the step of: means for correcting the error caused by a conductive drill collar using the equation:

$$\epsilon = \tan^{-1}\left[\frac{\mu_0\omega(OD^2 - ID^2)}{16R}\right]$$

where $\mu_0$=free space permeability $\omega$=tool rotation rate

OD=drill collar outside diameter

ID=drill collar inside diameter

R=drill collar material resistivity

24. The apparatus of claim 23 including:

means for correcting error in the magnitude |Hx| using the equation $$A = \left[\frac{1}{1 + \tan^2(\epsilon)}\right]^{\frac{1}{2}}$$

25. An apparatus for determining the azimuth angle of a borehole being drilled by instruments contained downhole in a tool in the drillstring, including:

means for rotating the drillstring;

accelerometer means for sensing while the drillstring is rotating the instantaneous acceleration components of gx or gy and gz at the location of the tool;

magnetometer means for sensing while the drillstring is rotating the instantaneous magnetic field components of hx or hy and hz at the location of the tool wherein the components gz and hz are along the axis of the drillstring, the components gx and gy are orthogonal to gz and the components hx and hy are orthogonal to hz;

means for determining the rotation rate of the drillstring;

means for determining the direction of the rotation of the drillstring;

means for determining azimuth angle from the relationship $$\text{Azimuth} = \tan^{-1}\left[\frac{(gyhx - gxhy)(gx^2 + gy^2 + Gz^2)^{\frac{1}{2}}}{(gx^2 + gy^2)Hz + Gz(hxgx + hygy)}\right]$$

where gx, gy, hx and hy are substituted with respect to rotation direction and orthogonal sensor as follows:

| Rotation | Orthogonal Sensor Used | | Substitution for: | | | |
|---|---|---|---|---|---|---|
| Direction | Accel | MAG | gx | gy | hx | hy |
| Clockwise | x | x | Re(Gx) | −Im(Gx) | Re(Hx) | −Im(Hx) |
| Clockwise | x | y | Re(Gx) | −Im(Gx) | Im(Hy) | Re(Hy) |
| Clockwise | y | y | Im(Gy) | Re(Gy) | Im(Hy) | Re(Hy) |
| Clockwise | y | x | Im(Gy) | Re(Gy) | Re(Hx) | −Im(Hx) |
| Counter CW | x | x | Re(x) | Im(Gx) | Re(Hx) | Im(Hx) |
| Counter CW | x | y | Re(Gx) | −Im(Gx) | −Im(Hy) | Re(Hy) |
| Counter CW | y | y | −Im(Gy) | Re(Gy) | −Im(Hy) | Re(Hy) |
| Counter CW | y | x | −Im(Gy) | Re(Gy) | Re(Hx) | Im(Hx) |

where $$Hx = \frac{2e^{i\epsilon}}{AKN} \sum_{n=0}^{N-1} \sum_{m=0}^{K-1} hx\left((n + mN)\frac{Tm}{N}\right)e^{-\frac{i2\pi n}{N}}$$

$$Hy = \frac{2e^{i\epsilon}}{AKN} \sum_{n=0}^{N-1} \sum_{m=0}^{K-1} hy\left((n + mN)\frac{Tm}{N}\right)e^{-\frac{i2\pi n}{N}}$$

$$Gx = \frac{2}{KN} \sum_{n=0}^{N-1} \sum_{m=0}^{K-1} gx\left((n + mN)\frac{Tm}{N}\right)e^{-\frac{i2\pi n}{N}}$$

$$Gy = \frac{2}{KN} \sum_{n=0}^{N-1} \sum_{m=0}^{K-1} gy\left((n + mN)\frac{Tm}{N}\right)e^{-\frac{i2\pi n}{N}}$$

Tm=period of the m'th tool rotation;

N=number of samples taken in one tool rotation;

K=number of tool rotations;

Gz=the time average of gz; and

Hz=the time average of hz.

26. The apparatus of claim 25 including:

means for determining Gz from the equation $$Gz = \frac{1}{KN} \sum_{n=0}^{N-1} \sum_{m=0}^{K-1} gz\left((n + mN)\frac{Tm}{N}\right)$$

27. The apparatus of claim 25 including:

means for determining Hz from the equation $$Hz = \frac{1}{KN} \sum_{n=0}^{N-1} \sum_{m=0}^{K-1} hz\left((n + mN)\frac{Tm}{N}\right)$$

28. The apparatus of claim 25 including:

means for correcting the error caused by a conductive drill collar using the correction factor $$\frac{1}{A} e^{i\epsilon}$$

wherein $$\epsilon = \tan^{-1}\left[\frac{\mu_0\omega(OD^2 - ID^2)}{16R}\right]$$

$$A = \left[\frac{1}{1 + \tan^2(\epsilon)}\right]^{\frac{1}{2}}$$

wherein $\mu_0$ = free space permeability
$\omega$ = tool rotation rate
OD = drill collar outside diameter
ED = drill collar inside diameter
R = drill collar material resistivity

29. A method for determining the azimuth angle of a borehole being drilled, while a drillstring is rotating about the axis of the borehole, by means of an instrument which is carried by the drillstring down the borehole, and which is rotating with the drillstring, comprising the steps of:

rotating the drillstring;

sensing on a plurality of occasions during a cycle of rotation of the drillstring the instantaneous components of the gravitational field in the direction of the drillstring axis and in a direction perpendicular thereto;

sensing on a plurality of occasions during a cycle of rotation of the drillstring the instantaneous components of the magnetic field in the direction of the drillstring axis and in a direction perpendicular thereto;

determining the time average of the gravitational component in the direction of the drillstring axis;

determining the time average of the magnetic field component in the direction of the drillstring axis;

determining the real and imaginary parts of the discrete fourier transform of said gravitational field component in a direction perpendicular to the drillstring axis as a function of time;

determining the real and imaginary parts of the discrete fourier transform of said magnetic field component in a direction perpendicular to the drillstring axis as a function of time; and determining the azimuth angle from said time averaged gravitational component and said time averaged magnetic field component in the direction of the drillstring axis, and from said real and imaginary parts associated with said gravitational field component in a direction perpendicular to the drillstring axis and with said magnetic field component in a direction perpendicular to the drillstring axis.

* * * * *

UNITED STATES PATENT AND TRADEMARK OFFICE
CERTIFICATE OF CORRECTION

PATENT NO. : 5,012,412

DATED : April 30, 1991

INVENTOR(S) : Walter A. Helm

It is certified that error appears in the above-identified patent and that said Letters Patent is hereby corrected as shown below:

| | |
|---|---|
| Col. 1, lines 20-21 | Delete "int he" and insert therefore -- in the --. |
| Col. 1, line 41 | Delete "to" and insert therefore -- of --. |
| Col. 1, line 46 | Delete "were" and insert therefore -- where --. |
| Col. 2, line 27 | After "of these two" insert -- loci. There are two lines of intersection of these two --. |
| Col. 2, line 48, | Delete "calculation" and insert therefore --calculated--. |
| Col. 4, line 21 | Delete "averages" and insert therefore -- averaged --. |
| Col. 4, line 24 | Delete "$(Gz)^{\frac{1}{2}}$ and insert therefore -- Gz --. |
| Col. 4, line 31 | In equation 1, delete the denominator "Gz" and insert therefore -- $(Gz)^{\frac{1}{2}}$ --. |
| Col. 4, line 53 | Delete "while" and insert therefore -- which --. |
| Col. 4, line 59 | Delete "instaneous" and insert therefore -- instantaneous --. |
| Col. 5, lines 20-21 | Delete "temperatures" and insert therefore -- temperature --. |
| Col. 5, line 52 | Delete "$\phi$" and insert therefore -- $\phi h$ --. |
| Col. 6, line 23 | In equation 5, the numerator should be -- $\lvert \dot{G}x \rvert$ --. |
| Col. 6, line 59 | Delete "(=1)" and insert therefore --(-1). --. |

UNITED STATES PATENT AND TRADEMARK OFFICE

CERTIFICATE OF CORRECTION

PATENT NO. : 5,012,412

DATED : April 30, 1991

INVENTOR(S) : Walter A. Helm

It is certified that error appears in the above-identified patent and that said Letters Patent is hereby corrected as shown below:

| | |
|---|---|
| Col. 8, line 9 | The column head "Description" should be aligned atop the second column of the table. |
| Col. 9, line 44 | In Table 2 in the definition for "KHSCLF", delete "magnitometer" and insert therefore -- magnetometer --. |
| Col. 11, line 63 | Delete the denominator"sin(inc)cos(θ) + cot(inc)cos (ϕ)" and insert therefore -- sin(inc)cot (θ) + cos(inc)cos(ϕ) --. |
| Col. 12, lines 1-4 | In the equation, the numerator should be --\|Hx\|sin(ϕ) --, and the denominator should be -- Hz sin(inc) + \|Hx\| cos(inc)cos (ϕ) --. |
| Col. 12, line 59 | Delete "\|Gz\|" and insert therefore -- \|Gx\| --. |
| Col. 12, line 66 | Delete "k" and insert therefore "K". |
| Col. 13, line 46 | Delete "of" and insert therefore "for". |
| Col. 42, line 43 | In the phrase "component gz being gy", delete "gz" and insert therefore -- gx --. |
| Col. 16, line 8 | Delete "\|Gz\|" and insert therefore -- \|Gx\| --. |

UNITED STATES PATENT AND TRADEMARK OFFICE

CERTIFICATE OF CORRECTION

PATENT NO. : 5,012,412

DATED : April 30, 1991

INVENTOR(S) : Walter A. Helm

It is certified that error appears in the above-identified patent and that said Letters Patent is hereby corrected as shown below:

| | |
|---|---|
| Col. 18, in the table after line 17 | In the column headed "gx", delete the entry in the fifth row, "Re(x)", and insert therefore -- Re(Gx) --. In the column headed "gy", delete the entry in the sixth row,"-Im(Gx)" and insert therefore -- Im(Gx) --. |
| Col. 19, line 20 | Delete "ED" and insert therefore -- ID --. |

Signed and Sealed this

Third Day of August, 1993

*Attest:*

Michael K. Kirk

MICHAEL K. KIRK

*Attesting Officer*

*Acting Commissioner of Patents and Trademarks*